United States Patent [19]

Goldstein

[11] 4,282,700

[45] Aug. 11, 1981

[54] STRETCH WRAPPER FOR PALLETIZED LOAD

[76] Inventor: Joseph Goldstein, 1325 Southwind Cir., Westlake Village, Calif. 91361

[21] Appl. No.: 29,331

[22] Filed: Apr. 12, 1979

[51] Int. Cl.[3] ..... B65B 13/04

[52] U.S. Cl. ..... 53/556; 53/588

[58] Field of Search ..... 53/399, 441, 465, 556, 53/588, 210, 391; 100/27

[56] References Cited

U.S. PATENT DOCUMENTS

| | | | |
|---|---|---|---|
| 989,020 | 4/1911 | Ljonglof | 100/27 |
| 1,606,290 | 11/1926 | Bunn | 100/27 X |
| 2,337,615 | 12/1963 | McLaren | 53/391 X |
| 2,591,136 | 4/1952 | Cleary | 53/588 X |
| 2,972,843 | 2/1961 | DuBroff | 53/588 X |
| 3,056,345 | 10/1962 | Bunn | 100/27 X |
| 3,641,738 | 2/1972 | Johnson | 53/391 |
| 3,662,513 | 5/1972 | Fabbri | 53/222 X |
| 4,080,886 | 3/1978 | Pierce, Jr. | 100/27 X |
| 4,095,395 | 6/1978 | Goldstein | 53/210 X |
| 4,109,445 | 8/1978 | Sholman | 53/210 X |
| 4,136,501 | 1/1979 | Connolly | 53/441 |

*Primary Examiner*—John Sipos

*Attorney, Agent, or Firm*—Allan M. Shapiro

[57] ABSTRACT

Stretch wrapper machine is mounted upon a pallet carrier so that, as a loaded pallet is carried, it is stretch-wrapped.

14 Claims, 10 Drawing Figures

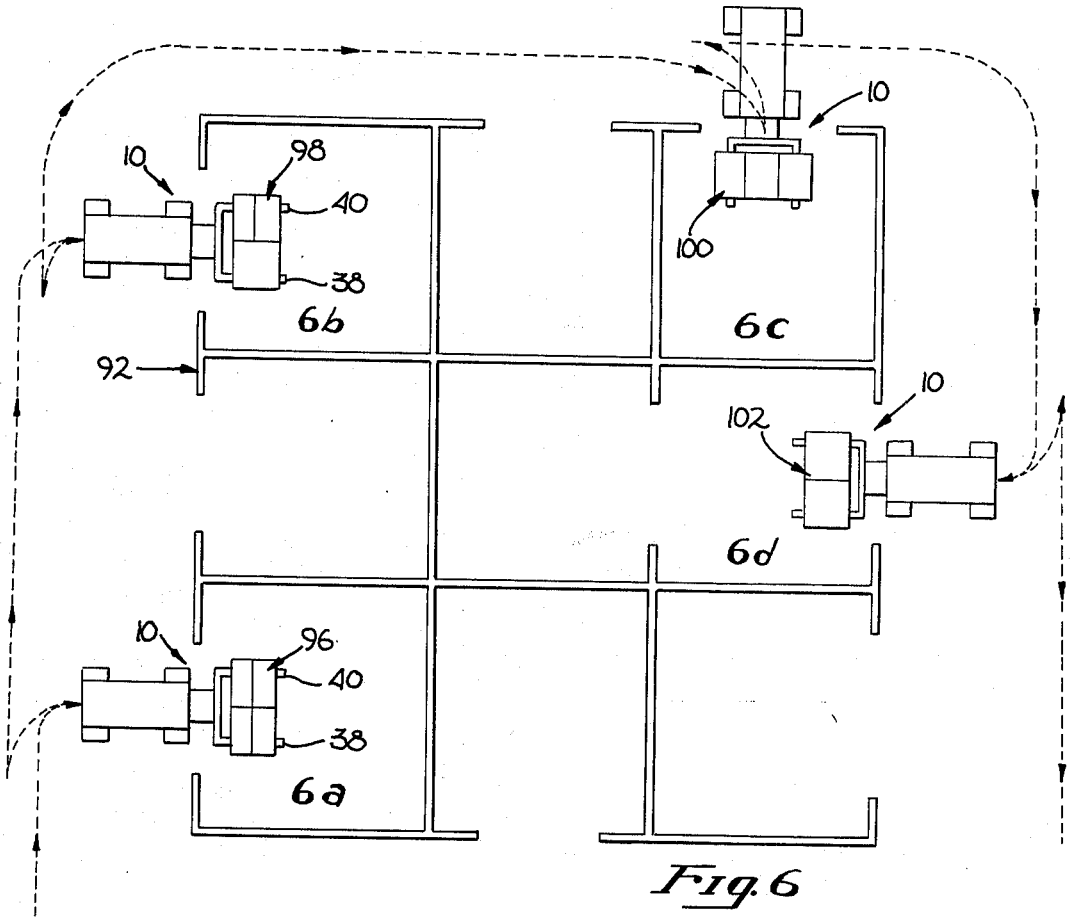
Fig. 6
Fig 6a
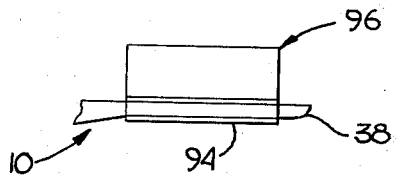
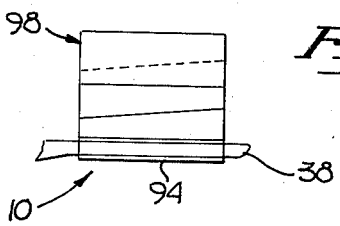
Fig. 6b
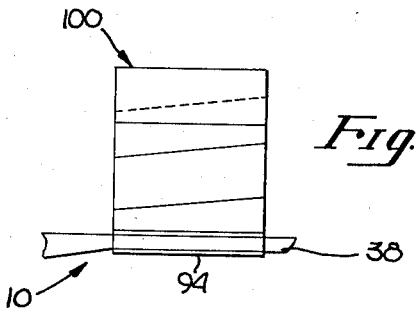
Fig. 6c
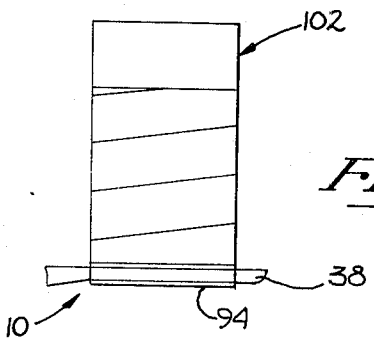
Fig. 6d

STRETCH WRAPPER FOR PALLETIZED LOAD

BACKGROUND OF THE INVENTION

1. Field of the Invention

This invention is directed to a stretch wrapper which is mounted on a pallet carrier so that, as a loaded pallet is moved, it is also stretch-wrapped.

2. Description of the Prior Art

Modern mechanized handling requires that a number of small packages be packed together so that they can be handled in larger units. Pallets are used as a base, and packages are stacked on the pallet to a convenient size and weight for mechanical handling. One approach to retaining the packages on the pallet has been steel banding. Steel bands were placed around the packages and the pallet, and the bands tightened and clamped. The problem with steel banding is that loads can shift and, under the wrong circumstances, all the packages on the outer extremities of the load directly under the steel bands can be crushed. Furthermore, the steel bands are most useful on heavy metal objects, such as pipe and other forms of steel. It must also be noted that steel banding does not provide any weather protection for the packages.

A newer method of securing packages on a pallet to provide a palletized load is to shrink wrap the packages and the pallet. In this arrangement, bags are made out of shrinkable material (usually polyethylene), and the bag is placed over the palletized packages. Thereupon, the bag is subjected to heat whereupon it shrinks to unitize the palletized load. Shrink wrapping is useful for loads which are uniform size, but requires special equipment for causing the shrinkage. Since heat is used to cause the shrinkage, it cannot be used in cold rooms or other areas where high heat loads are objectionable. Furthermore, it cannot be used over polyethylene wrapped packages because of sticking between the shrink wrapping material and such packages.

To overcome these disadvantages, stretch-wrapping has been developed. In these machines, one of which is seen in Lancaster, U.S. Pat. No. 3,867,806, a stack of packages is placed on a turntable. Usually, these packages are mounted on a pallet. The turntable is rotated, and the palletized load of packages is wrapped with a stretch-wrap material. This material may be polyethylene or polyvinylchloride web or film and is manufactured to be able to stretch at least 25 percent. During wrapping of the load, tension on the stretch-wrap film provides a tension whioh stretches the film from 15 to 25 percent. The film is thin, usually about 1,100th of an inch thick, and the load is wrapped with as many thicknesses as is necessary to obtain the desired unitized load strength.

The stretch wrap film may be as tall as the load or may be narrower than the height of the load. In the latter case, the narrower film is spiral-wrapped around the load. Since more wraps are necessary at the top and bottom of the load than at the middle for best strength, this is more economical of material. However, these stretch-wrap concepts have been limited to those loads which can be placed on the turntable and rotated.

Goldstein U.S. Pat. No. 4,067,174 employs stretch-wrap film and overcomes many of the disadvantages of the prior art by having a motive unit which carries the stretch-wrap unit, with the motive unit guided around the material to be wrapped. In employing that stretch-wrap unit, the material to be wrapped is in a stationary position, and the motive unit is guided around the material by any of a variety of guiding or steering devices and methods.

Goldstein U.S. Pat. No. 4,095,395 further improves stretch-wrapping equipment, again by employing a motive unit carrying a stretch-wrap unit. In this case, the motive unit is self-guided around the material to be wrapped by employing a follower to contact the load so that no separate guiding or steering equipment is necessary. In this way, irregular loads are more easily accommodated, and no special location with its guiding track is necessary.

In each of the foregoing stretch-wrap methods, a certain amount of floor space is required. The amount of floor space is particularly large when the turntable structure is employed, but sufficient floor space must be provided for the stretch-wrap equipment which travels around the load.

SUMMARY OF THE INVENTION

In order to aid in the understanding of this invention, it can be stated in essentially summary form that it is directed to a stretch wrapper for a load, with the stretch wrapper being mounted on the load carrier so that, as the load is transported, it is also stretch-wrapped.

It is thus an object of this invention to provide a stretch wrapper for a load which is to be carried, usually a palletized load, with the stretch wrapper being mounted on a pallet carrier so that, during pallet and load transportation, the pallet load is stretch-wrapped. It is another object to provide a pallet carried having mounted thereon a stretch-wrap unit so that the stretch-wrap material can be wound around the non-rotating palletized load while it is carried on the pallet carrier. It is another object to provide a stretch wrapper for a palletized load with the stretch wrapper mounted on the pallet carrier so that the stretch wrapper uses the travel time of the pallet carrier as the wrapping time to save time, and furthermore to use the travel space of the pallet carrier for the wrapping space so that additional wrapping space is not necessary, and furthermore used the pallet carrier operator as the stretch wrapper operator so that no additional operator is necessary. It is a further object to combine the pallet movement with the pallet load stretch-wrapping to provide a single operation which accomplishes both the movement of the pallet and the stretch-wrapping thereof. It is a further object to provide a mobile stretch wrapper mounted on the pallet carrier so that it can be employed outdoors where no other power is available, such as in an agricultural field where boxed agricultural goods (such as strawberries) are being picked and packaged for shipping.

The features of the present invention which are believed to be novel are set forth with particularity in the appended claims. The present invention, both as to its organization and manner of operation, together with further objects and advantages thereof, may be best understood by reference to the following description taken in conjunction with the accompanying drawings.

BRIEF DESCRIPTION OF THE DRAWINGS

FIG. 6 is a plan view of a schematically shown warehouse showing the step-by-step assembly of a load on a pallet carrier with step-by-step stretch-wrapping of the components of the load.

FIGS. *6a, 6b, 6c* and *6d* show corresponding steps of the load assembly corresponding to the similar figure numbers in FIG. 6.

DESCRIPTION OF THE PREFERRED EMBODIMENT

Figure 1:
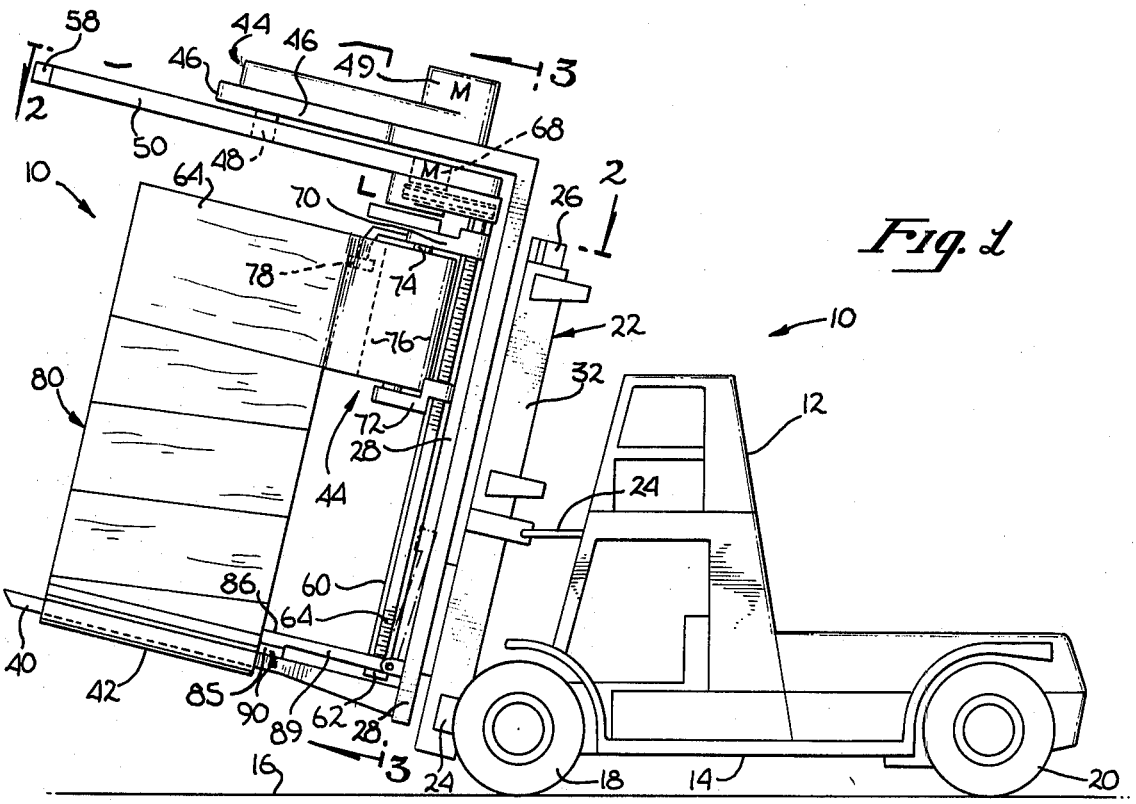
FIG. 1 is a side-elevational view of the stretch wrapper for palletized load in accordance with this invention shown combined with a pallet carrier in the form of a forklift truck.
Figure 4:
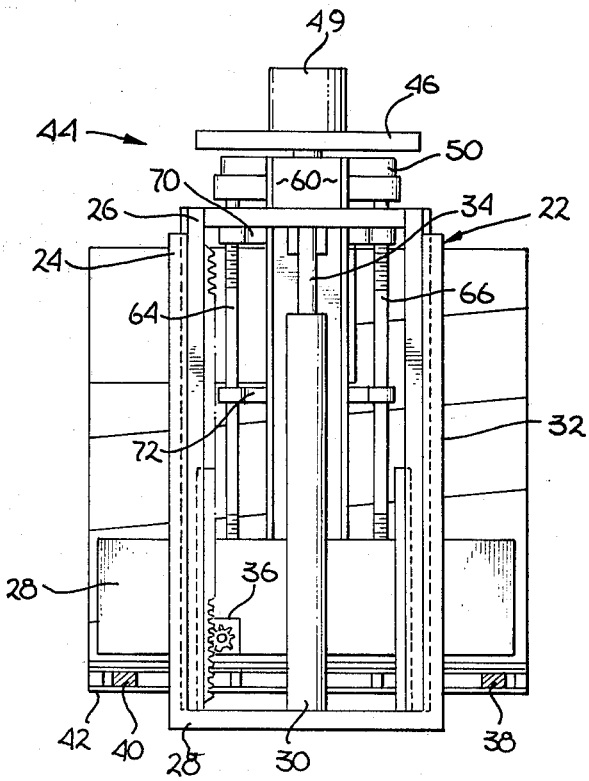
FIG. 4 is an upright section taken generally along the line 4—4 of FIG. 2.

The stretch wrapper device in combination with the pallet carrier is shown in side elevation in FIG. 1 and is indicated at 10 as being a carrier-wrapper system for a palletized load. The system 10 comprises pallet carrier 12 which is conveniently in the form of a forklift truck. Carrier 12 has a chassis 14 which is supported from the ground 16 by support and propulsion wheels which are usually arranged in pairs, with front wheel 18 and rear wheel 20 being seen from the side shown in FIG. 1. Mast 22 is pivotally mounted on frame 14. Link 24 between the mast and the frame controls the degree of mast tilt. Mast 22 is provided with a telescoping section and, in the structure shown, a double telescoping mast is illustrated. Intermediate frame 26 is telescopically mounted in main frame 32 of the mast which is pivotally supported on the chassis. Fork carrier 28 is slidably mounted on intermediate frame 26. Cylinder 30 is mounted on the crosspiece base of the main frame 32, and its piston rod 34 (see FIG. 4) is mounted to the underside of the top crosspiece of fork carrier 28. By introduction of hydraulic fluid to the bottom of cylinder 30, the fork carrier is raised. Motor 36 has its pinion engaging in a rack secured to the intermediate frame 26 to control the vertical position of the intermediate frame. Motor 36 is preferably automatically controlled so that intermediate frame 26 has equal overlap with both main frame 32 and fork carrier 28 at any vertical position of the fork carrier.

Fork carrier 28 has a pair of forks 38 and 40 affixed thereto and extending forward therefrom. Pallet 42 is of generally standard construction and usually has top and bottom surfaces, as well as openings therethrough to receive the forks. Most pallets are the same on the top and bottom, as illustrated for the pallet 42, and they can be used either side up. A few pallets have only a top deck with skids extending therebelow so that the forks can pass below and lift under the top deck. In use, to pick up a pallet, mast 22 is tilted to the vertical or forward-of-vertical position, and fork carrier 28 is lowered so that forks 38 and 40 are at a proper height to enter the openings in the pallet. When the pallet is on the floor, then the forks are slightly above the floor. The pallet carrier is driven forward so that the forks engage through the pallet, and, thereupon, the pallet is lifted and the mast is tilted back. Tilting back permits the load to be held in a more stable position, and it better distributes the load on the wheels of the pallet carrier. Usually, the pallet carrier has an operator's position, with the operator riding thereon with the controls for the various pallet lifting and pallet-carrier propulsion functions being located convenient to the operator position.

The stretch wrapper system 10 includes stretch wrapper 44 integrated with the mast portion of the pallet carrier. Arm 46 is formed integrally with fork carrier 28 and extends forward at the top of the fork carrier. Drive pin 48 extends downward from arm 46 at a fixed position forward of fork carrier 28. Drive pin 48 is rotated by motor 49 through a speed reducer so that pin 48 rotates at the desired stretch-wrapping speed.

Stretch wrapper swing arm 50 is mounted on drive pin 48 to swing therewith. Drive pin 48 carries on the lower end thereof drive block 52 which is pinned thereto for rotation therewith. Drive block 52 engages in tee slot 54 in swing arm 50. Compression spring 56 engages between drive block 52 and the closure block 58 on the outer end of the tee slot to urge swing arm 50 toward the retracted position where the drive block is engaged all the way into tee slot 54. This is the position shown in FIG. 1 and shown in full lines in FIG. 2. In this position, swing arm 50 is approximately centered on drive pin 48. When motor 49 rotates drive pin 48, then swing arm 50 swings on the axis of the drive pin. When no other load is applied, the swing arm is positioned with its mid-point substantially at the drive pin.

Support 60 is secured to the outer end of swing arm 50 opposite closure block 58. It extends downward just forward of fork carrier 28 and carries screw support 62 on the bottom end thereof, see FIGS. 2 and 3. Screws 64 and 66 are lead screws, and they are rotatably mounted on their bottom end in screw support 60 and are rotatably mounted at their upper end on the forward end of swing arm 50. The forward end of swing arm 50 also carries screw motor 68 which is connected through a drive train to both of the screws so that they cause equal motion in the same direction of nuts on the lead screws.

Figure 2:
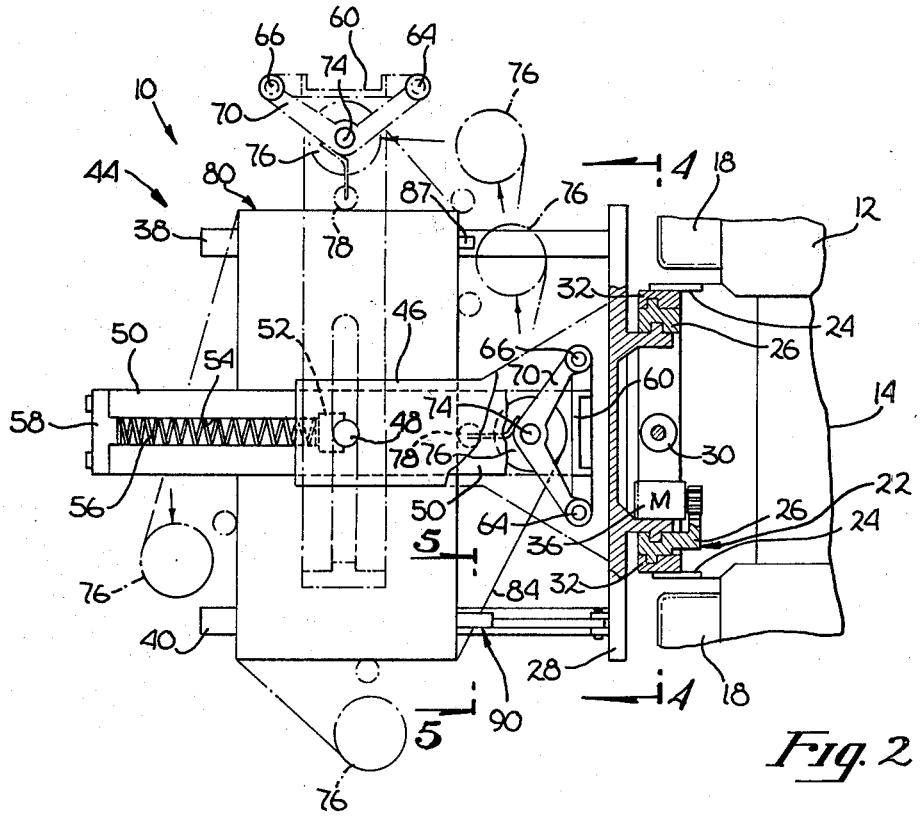
FIG. 2 is a plan view thereof looking down the mast of the forklift truck, as seen along the line 2—2 of FIG. 1.
Figure 3:
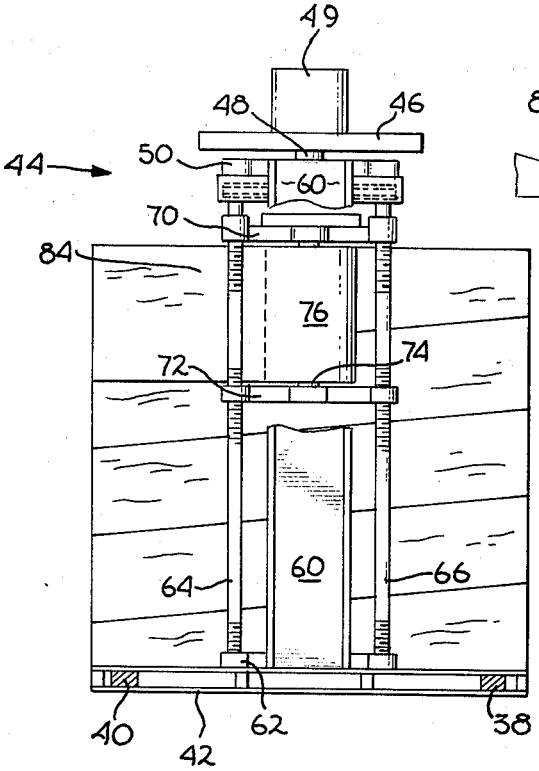
FIG. 3 is an upright section taken generally along the line 3—3 of FIG. 1.

Upper yoke 70 and lower yoke 72 each have a nut on each of the screws. The yokes bridges the space between the screws and, as seen in FIGS. 1 and 2, carry stretch-wrap roll pivot pin 74. Stretch-wrap roll 76 is mounted on the pivot pin for unwinding therefrom. A suitable tensioner is provided so that the stretch-wrap roll resists unwinding at a predetermined web tension for proper stretch-wrapping. By operation of motor 68, yokes 70 and 72 can be moved up and down along lead screws 64 and 66 to control the height of wrapping. Guide roll 78, see FIGS. 1 and 2, prevents contact by stretch-wrap roll 76 onto a load to be wrapped.

Figure 5:
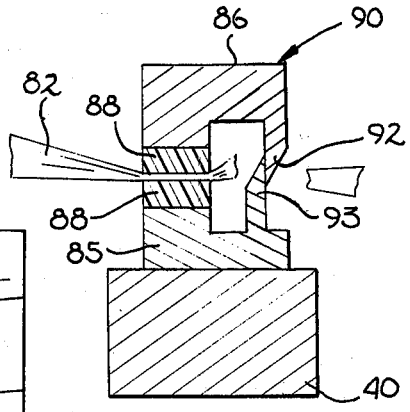
FIG. 5 is an enlarged section through the shearclamp for the stretch-wrap material taken generally along the line 5—5 of FIG. 2.

Load 80 is carried on pallet 42 and usually consists of a plurality of cartons or boxes which may be of different shapes and sizes. They are stacked into as stable a form as is practical, and the pallet is engaged on the forks of the forklift truck. The bottom jaw 85 (see FIG. 1) of cutter-clamper 90 (see FIGS. 2 and 5), and stop member 87 (see FIG. 2), are rigidly secured to respective forks 40 and 38 and engage the pallet as spacers to prevent the pallet from going too far back onto the forks when the forks engage in the pallet. But when the pallet is engaged by the forks, swing arm 50 is in the rest position where the stretch-wrap roll 76 is toward the fork carrier 28, as shown in FIGS. 1 and 2. In this position, support 60 and the lead screws, as well as the stretch-wrap roll and its yokes are out of the way of loading of the pallet. Furthermore, in this position, the beginning end 82, see FIG. 5, of web 84 extending from stretch-wrap roll 76 is engaged in resilient clamp members 88 of cutter-clamper 90, see FIG. 5. Cutter-clamper 90, in addition to clamp members 88 on jaws 85 and 86, has shear blades 92 and 93 which cut off the free end of the web when the cutter-clamper is closed. Cutter-clamper 90 has its upper jaw 86 as the end of movable member 89 which is pivoted on fork carrier 28 and is in the web clamp position during pallet loading.

With the outer end of the web thus clamped, stretch-wrapping can begin. Motor 49 drives arm 50 and swings the stretch-wrap roll around load 80. Web 84 thus wraps the load. When the load 80 is tall of the nature indicated in FIG. 1, then the motor 64 drives the lead screws to spirally wind the web around the tall load. When stretch-wrapping is partially done, cutter-clamp 90 is opened. When stretch-wrapping is completed, roll 76 is in its lowermost position, and before the pallet is set on the floor and disengaged from the forks, cutter-clamper 90 is again closed cutting the wrapped load free of stretch-wrap roll 76. The cut end which is closer to the roll is restrained in clamp jaws 88 ready for the beginning of the next wrapping. The stretch-wrap mechanism has its arm 50 and support 60, together with the pertinent portions, in the rest position shown in FIGS. 1 during this cut-and-clamp operation so that pellet 42 with its load 80 can be unloaded and a new pallet with its load taken up.

During swinging of arm 50 with the carrying of the stretch-wrap roll 76 around the load, guide roll 78 engages load 80 so that the radius from the pivot pin to the guide roll can increase as the stretch-wrap roll moves from its rest position. As the stretch-wrap roll 76 moves counterclockwise around load 80, as shown in FIG. 2, spring 56 can compress to provide a larger wrapping radius than the radius in the rest position. Irregular, rectangular and other non-round loads can be efficiently wrapped.

With the capability of stretch-wrapping a palletized load during the moving of the load, the stretch wrapper becomes available for stretch-wrapping a load as the load is progressively being built. Referring to FIGS. 6, *6a*, *6b*, *6c*, and *6d*, progressive loading and wrapping are described. The combination pallet carrier and stretch wrapper described above with respect to FIGS. 1 through 4 is a cooperative combination identified as carrier-wrapper system 10. In FIG. 6, warehouse 92 has plurality of individual spaces or areas in which different materials are manufactured or stored. When a mixed load of these different materials needs to be shipped, the parts need to be assembled on a pallet in appropriate quantities. Thus, in FIG. 6, the carrier-wrapper system 10 moves into space *6a* carrying pallet 94 on its forks. A first portion 96 of a load is placed on the pallet, and that portion is secured together by stretch-wrapping as carrier-wrapper system 10 moves from spaces *6a* to *6b*. A second portion 98 is placed on the already stretch-wrapped first load portion 96 in space *6b* and thereupon is stretch-wrapped with this new stretch-wrap engaging over both the first and second portions of the load. During this second stretch-wrapping operation, the carrier-wrapper system 10 is moving toward the space *6c* wherein the third portion of the load 100 is placed on the first and second portions which are already stretch-wrapped together. This third portion of the load is illustrated in FIG. *6c* and is stretch-wrapped together with the first and second portions during travel of the carrier-wrapper system 10 to space *6d*. In space *6d*, the fourth portion 102 is stretch-wrapped together with the original portions of the load. In this way, the load is assembled on the pallet and is progressively stretch-wrapped as it is assembled during the transportation from one assembly point to the next. The stretch-wrapping of the load as it is assembled takes no additional time, and there is no need to carry the load to a stretch-wrapping location or facility. Thus, with the carrier-wrapper system 10, stretch-wrapping is accomplished with the load on the pallet carrier without requiring additional space or manpower.

This invention having been described in its preferred embodiment, is it clear that it is susceptible to numerous modifications and embodiments within the ability of those skilled in the art and without the exercise of the inventive faculty. Accordingly, the scope of this invention is defined by the scope of the following claims.

What is claimed is:

1. A stretch-wrap system comprising:

a load carrier for supporting and carrying a load, said load carrier being a pallet carrier, said pallet carrier having means thereon for engaging, supporting and transporting a pallet and a load carried on the pallet; and a stretch wrapper mounted on said pallet carrier and positioned for wrapping a load carried on said pallet carrier with a web of stretch-wrap film, said stretch wrapper having a forwardly positioned pivot and a swinging arm pivoted on said pivot and positioned over said pallet-engaging means, a stretch-wrap roll support mounted on said swinging arm means for moving said swinging arm about said pivot and thereby moving said roll around the load, said swinging arm including means for varying the radius between said swinging arm pivot and said stretch-wrap roll support during the wrapping operation in response to the size of the load so that a stretch-wrap roll can be mounted on said stretch-wrap roll support and said swinging arm can carry a stretch-wrap roll on varying radius around the load for winding stretch-wrap film around the load so that the load can be wrapped with stretch-wrap film while the load is being carried and transported on said load carrier.

2. The stretch-wrap system of claim 1 wherein said stretch-wrap roll support is mounted for movement in a direction generally parallel to said swing axis of said swing arm so that stretch-wrap film being wrapped from a stretch-wrap roll on said roll support can be spirally wrapped around a load.

3. A stretch-wrap system comprising:

a pallet carrier having means thereon for engaging, supporting and transporting a pallet together with a load carried on the pallet;

a stretch wrapper mounted on said pallet carrier and positioned for wrapping a load carried on said pallet carrier with a web of stretch-wrap film, said stretch wrapper having a pivot pin mounted on said pallet carrier, said pivot pin being positioned over said pallet-engaging means, a swinging arm mounted to swing about said pivot, said arm having a slot therein, said swinging arm pivot pin engaging in said slot, a stretch-wrap roll support mounted on said swinging arm so that a stretch-wrap roll can be mounted on said stretch-wrap roll support and said swinging arm can carry a stretch-wrap roll around the load for winding stretch-wrap film around the load, with the slot in said swinging arm directed towards said stretch-wrap roll support, means for varying the relative positions of said roll and said pivot in said slot so that the distance between said stretch-wrap roll carrier and said pivot varies during the wrapping operation in response to the size of the load and the load can be wrapped with stretch-wrap film while the load is being carried and transported on said load carrier.

4. The stretch-wrap system of claim 3 wherein a spring interengages between said arm and said pivot pin to urge said arm to a minimum radius of said stretch-wrap roll carrier.

5. A stretch-wrap system comprising:

a pallet carrier, said pallet carrier having means thereon for engaging, supporting and transporting a pallet and a load mounted on the pallet, said pallet carrier having a mast thereon extending above said load-engaging means;

a stretch wrapper mounted on said mast of said pallet carrier, said stretch wrapper being positioned for wrapping a load spaced from said mast and carried on a pallet on said pallet carrier with a web of stretch-wrap film, said stretch wrapper including a pivot on said mast and a swinging arm pivoted on said pivot and positioned over said pallet-engaging means and a stretch-wrap roll support mounted on said swinging arm, said swinging arm including means for varying the radius between said swinging arm pivot and said stretch-wrap roll support so that a stretch-wrap roll can be mounted on said stretch-wrap roll support and said swinging arm can carry a stretch-wrap roll on varying radius around the load through the space between said mast and the load for winding stretch-wrap film around the load while the load is being carried and transported on said pallet carrier; and a guide roll mounted to said stretch-wrap roll support and directed towards said pivot pin from said stretch-wrap roll carrier, said guide roll being engageable against a load on a pallet so that the swinging radius of said swinging arm during the wrapping operation is controlled by the size of the load on the pallet to cause said stretch-wrap roll carrier to move a stretch-wrap roll through the space between said mast and the load on the pallet.

6. The stretch-wrap system of claim 5 wherein said stretch-wrap roll carrier is mounted for movement in a direction generally parallel to said swing axis of said swinging arm so that stretch-wrap film being wrapped from a stretch-wrap roll on said roll holder can be spirally wrapped around a load.

7. The stretch-wrap system of claim 6 wherein a lead screw is mounted on said swing arm and said stretch-wrap roll holder is mounted on said lead screw so that rotation of said lead screw causes the axial motion of said stretch-wrap roll holder.

8. The stretch-wrap system of claim 7 wherein a motor is connected to rotate said lead screw and a motor is connected to swing said arm so that stretch-wrapping is motorized.

9. The stretch-wrap system of claim 8 wherein said pallet carrier is a forklift truck.

10. A stretch-wrap system comprising:

a fork lift truck for supporting and carrying a load, said fork lift truck having a mast thereon and forks thereon for engaging, supporting and transporting a pallet with a load carried on the pallet, with the load spaced from said mast; and a stretch wrapper mounted on said mast of said fork lift truck, said stretch wrapper including a pivot pin positioned over a load on said forks and a swinging arm pivotally mounted on said pivot pin, a stretch-wrap roll support mounted on said swinging arm, means for moving said swinging arm about said pivot and thereby moving said roll around the load, said swinging arm having means thereon for varying the distance between said stretch-wrap roll support and said pivot pin during the wrapping operation in response to the size of the load so that a stretch-wrap roll can be mounted on said stretch-wrap roll support and said swinging arm can carry the stretch-wrap roll on varying radius around the load including the space between said mast and the load for winding stretch-wrap film around the load so that the load can be wrapped with stretch-wrap film while the load is being carried and transported on said fork lift truck.

11. The stretch-wrap system of claim 2 wherein a lead screw is mounted on said swing arm and said stretch-wrap roll carrier is mounted on said lead screw so that rotation of said lead screw causes the axial motion of said stretch-wrap roll carrier.

12. The stretch-wrap system of claim 11 wherein a motor is connected to rotate said screw and a motor is connected to swing said arm so that stretch-wrapping is motorized.

13. The stretch-wrap system of claim 12 wherein said pallet carrier is a forklift truck.

14. The stretch-wrap system of claim 12 wherein a stretch-wrap film cutter-clamp is positioned between said stretch-wrap roll carrier and the load so that the stretch-wrap film can be severed between said roll carrier and the load upon completion of stretch-wrapping of the load and the film end adjacent said roller carrier can be clamped.

* * * * *